US006868558B2

(12) United States Patent
Majerfeld

(10) Patent No.: US 6,868,558 B2
(45) Date of Patent: Mar. 22, 2005

(54) OUTERWEAR GARMENT

(75) Inventor: Eddie Majerfeld, St-Laurent (CA)

(73) Assignee: Mazsport Garment Manufacturing Inc., St-Leonard (CA)

( * ) Notice: Subject to any disclaimer, the term of this patent is extended or adjusted under 35 U.S.C. 154(b) by 0 days.

(21) Appl. No.: 10/352,866

(22) Filed: Jan. 29, 2003

(65) Prior Publication Data

US 2004/0143884 A1 Jul. 29, 2004

(51) Int. Cl.[7] ..... A41D 3/02
(52) U.S. Cl. ..... 2/96
(58) Field of Search ..... 2/96, 82, 108, 2/93, 94, 102, 97, 456, 457, 49.4, 69, 49.5, 904, 915, DIG. 2; 428/53, 57

(56) References Cited

U.S. PATENT DOCUMENTS

| | | | | | |
|---|---|---|---|---|---|
| 2,441,122 | A | | 5/1948 | Sturz | |
| 2,582,772 | A | * | 1/1952 | Egbert | 2/95 |
| 2,636,176 | A | * | 4/1953 | Ross | 2/93 |
| 4,320,538 | A | | 3/1982 | Saft | |
| 4,608,715 | A | * | 9/1986 | Miller et al. | 2/1 |
| 5,029,344 | A | | 7/1991 | Shannon et al. | |
| 5,341,514 | A | * | 8/1994 | Dale | 2/96 |
| 5,406,648 | A | | 4/1995 | Butzer et al. | |
| 5,529,823 | A | | 6/1996 | Aumann | |
| 5,718,000 | A | | 2/1998 | Ost et al. | |

* cited by examiner

*Primary Examiner*—Tejash Patel
(74) *Attorney, Agent, or Firm*—Ogilvy Renault

(57) ABSTRACT

An outerwear garment comprises an inner shell having first closure means at first front edges thereof and first fastening means spaced from the first front edges on an outer surface of the inner shell. The inner shell is adapted for removable engagement with an insulated outer shell having greater insulating properties than the inner shell. The insulated outer shell has second closure means that are engageable with the first fastening means for removably fastening the insulated outer shell to the inner shell overtop thereof, to provide more insulation to said inner shell without requiring removal thereof by a user.

20 Claims, 3 Drawing Sheets

Fig. 3
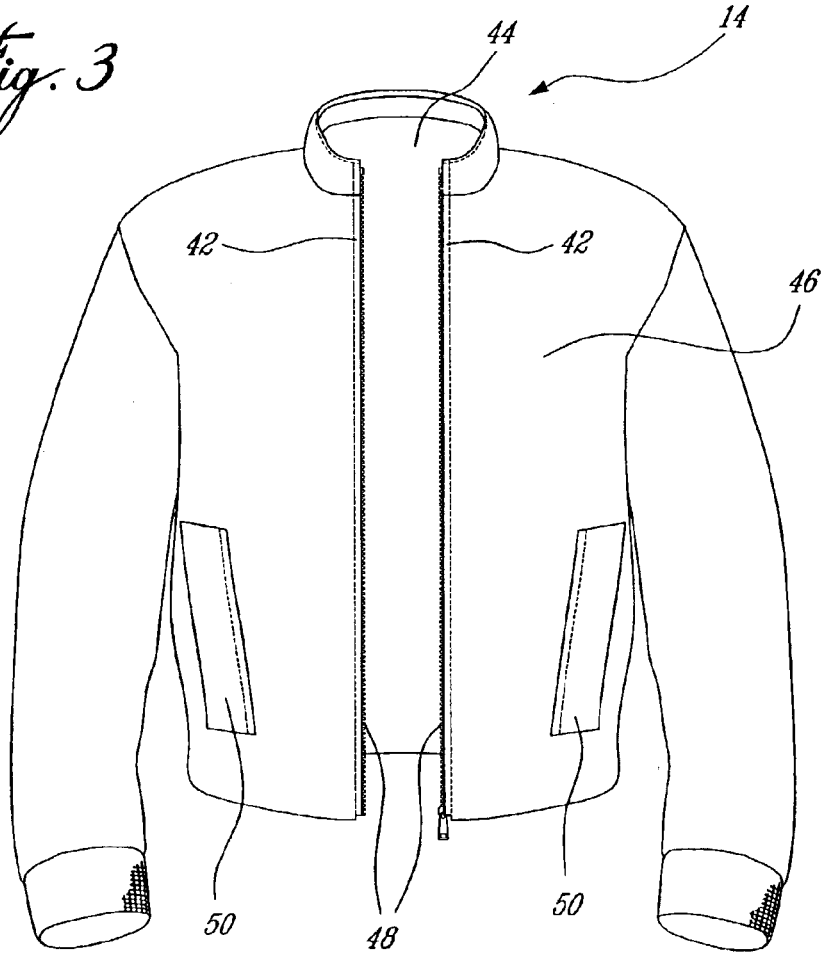
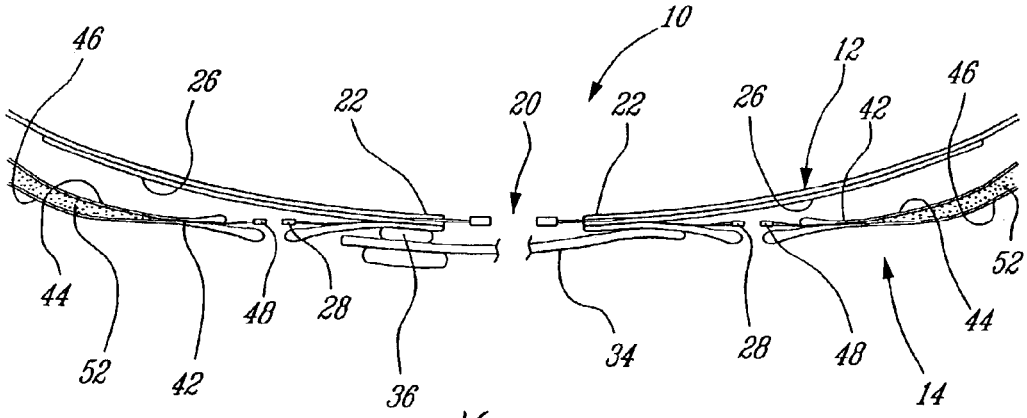
Fig. 4

OUTERWEAR GARMENT

TECHNICAL FIELD

The present invention relates generally to outerwear garments such as coats, jackets and the like. Particularly, the present invention relates to an outerwear garment of the type having an inner shell and an outer shell.

BACKGROUND OF THE INVENTION

Coats or jackets having a removable inner insulated liner are well known. Various types of insulating liners being fastenable within an outer shell are commonly used to convert a thin outer shell into a warmer, double-layered jacket. These types of dual-layered jackets are popular as they provide a multi-purpose garment that is conveniently adaptable to quickly changing weather or to climates having large ranges in temperatures. As such, in warmer weather, the thin outer shell can be worn by itself, providing for a light windbreaker or raincoat for example. A thicker, inner insulated liner can subsequently be fastened within the thinner outer shell, thereby creating an insulated double-layer jacket suitable for much colder weather.

U.S. Pat. No. 4,103,361, issued to Carmen on Aug. 1, 1978, for example, discloses an outerwear coat provided with a removable inner liner. The liner has fastener means spaced from the edges of the liner such that it can engage mating fastener means on the edges of an outer shell. The portion of the inner liner between each front edge and each spaced fastener means defining, marginal panels which provide for an increased overall girth of the combined coat when the liner is fitted within the outer shell. This permits the internal girth of the coat to be the same whether the outer shell is worn by itself, or the outer shell is worn with the inner insulation liner therein.

Other multi-layer garments are also known that generally have an inner insulated liner, fastenable within an outer shell, thereby adding a warm inner layer to the interior surface of the outer shell. When converting from a thin outer shell that is being worn by itself, to a warmer insulated jacket, the outer shell must first be removed and the inner insulated liner can then be subsequently inserted within the outer shell and fastened in place.

However, for some uses of such a convertible jacket, it is considerably inconvenient or impractical to have to remove the relatively thin outer shell in order to be able to add the insulated layer to create a warmer, double-layered outerwear garment. For example, a snowmobile or motorcycle rider who is wearing a first, single-layer outer jacket but would like to add an insulated layer as the weather becomes colder, would have to completely remove the first jacket, thereby exposing themselves to cold or wet weather, for example, in order to be able to insert an insulated liner within the first outer jacket. This is evidently impractical when such a conversion from a single-layer jacket to a warmer, double-layered jacket must be done while traveling, for example.

Thus, there exists a need for a multi-layer outerwear garment comprising an insulated layer and a thinner shell, that permits the insulated layer to be fastened to the thinner shell without first having to remove the thinner shell.

SUMMARY OF THE INVENTION

It is an object of the present invention to provide an outerwear garment having a first shell and a removably engageable insulated layer, the insulated layer being fastenable to the first shell without having to remove the first shell.

It is another object of the present invention to provide an outerwear garment having a insulated outer layer and a thinner inner layer, the outer layer being fastenable to the inner layer without having to first remove the inner layer.

Therefore, in accordance with the present invention, there is provided an outerwear garment comprising: an inner shell adapted for independent wear and having first closure means at first front edges thereof and first fastening means spaced from said first front edges on an outer surface of said inner shell, said first closure means closing said first front edges of said inner shell; and an insulated outer shell having greater insulating properties than said inner shell and including second closure means, said second closure means being engageable with said first fastening means for removably fastening said insulated outer shell to said inner shell overtop thereof, to provide more insulation to said inner shell without requiring removal thereof by a user.

There is also provided, in accordance with the present invention, an outerwear garment comprising an inner shell having first closure means at first front edges thereof and first fastening means spaced from said first front edges on an outer surface of said inner shell; said inner shell being adapted for removable engagement with an insulated outer shell having greater insulating properties than said inner shell, said insulated outer shell having second closure means engageable with said first fastening means for removably fastening said insulated outer shell to said inner shell overtop thereof, to provide more insulation to said inner shell without requiring removal thereof by a user.

BRIEF DESCRIPTION OF THE DRAWINGS

Further features and advantages of the present invention will become apparent from the following detailed description, taken in combination with the appended drawings, in which:

FIG. 3 shows a front elevation view of the outer shell of FIG. 1.

FIG. 4 shows a horizontal cross-sectional view taken through line 4—4 of FIG. 1.

DETAILED DESCRIPTION OF THE PREFERRED EMBODIMENT

Figure 1:
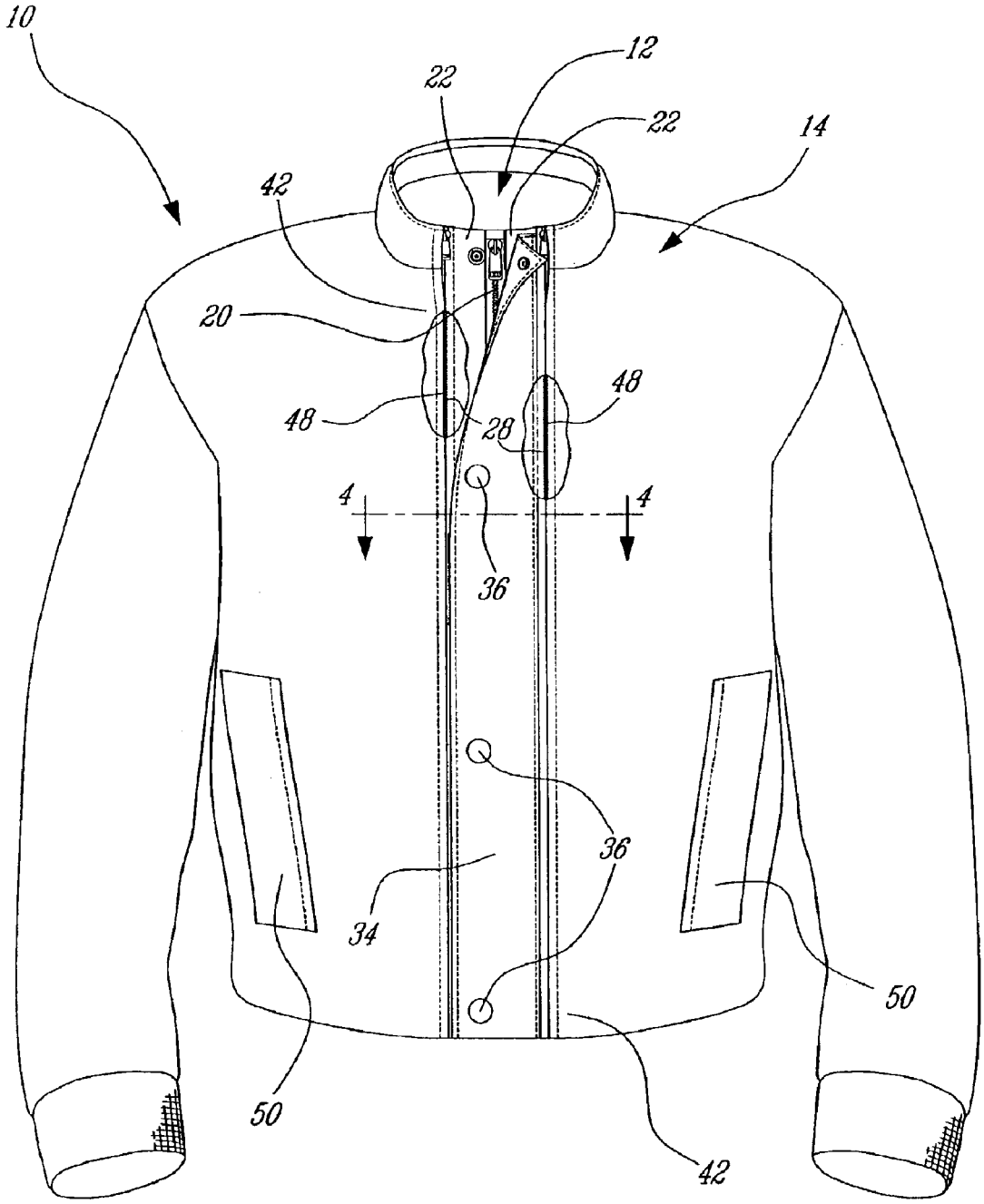
FIG. 1 shows a front elevation view of an composite outerwear garment, including an inner shell and an outer shell, according to the present invention.

Referring to FIG. 1, the composite outerwear garment 10, preferably a jacket, comprises an inner shell 12 and an outer shell 14. The outerwear garment 10 is particularly adapted for use as a snowmobile, motorcycle or all terrain vehicle jacket, however it is to be understood that the outerwear garment 10, given certain fit, cut, finish and/or material selection modifications which will be evident to one skilled in the art, can also be employed as a multiple purpose coat for any application, whether athletic, casual or otherwise. Although the outerwear garment 10 is depicted and described herein as a jacket, it is to be understood that the outerwear garment 10 according to the present invention can similarly also comprise other garments. These can include, for example, composite pants having inner and outer shells that are engageable as per the present invention described herein with preference to an outerwear jacket.

The outerwear garment 10 described and depicted herein can be worn as an assembled double-layer garment comprising an inner shell 12 and an outer shell 14, but it is to be understood that both the inner shell 12 and the outer shell 14 can be worn independently of the other. The very nature of the outerwear garment 10 of the present invention is such that the inner shell 12 can be worn by itself when desired, and that the outer shell 14 can be added overtop the inner shell 12, and fastened thereto, when greater protection and/or insulation is required. As will be described in further-detail below, the outer shell 14 can be fastened to the inner shell 12, without having to first remove the inner shell 12. This can be very practical for certain applications in which removal of the inner shell 12 would mean exposing the user to undesirable climatic conditions.

Figure 2:
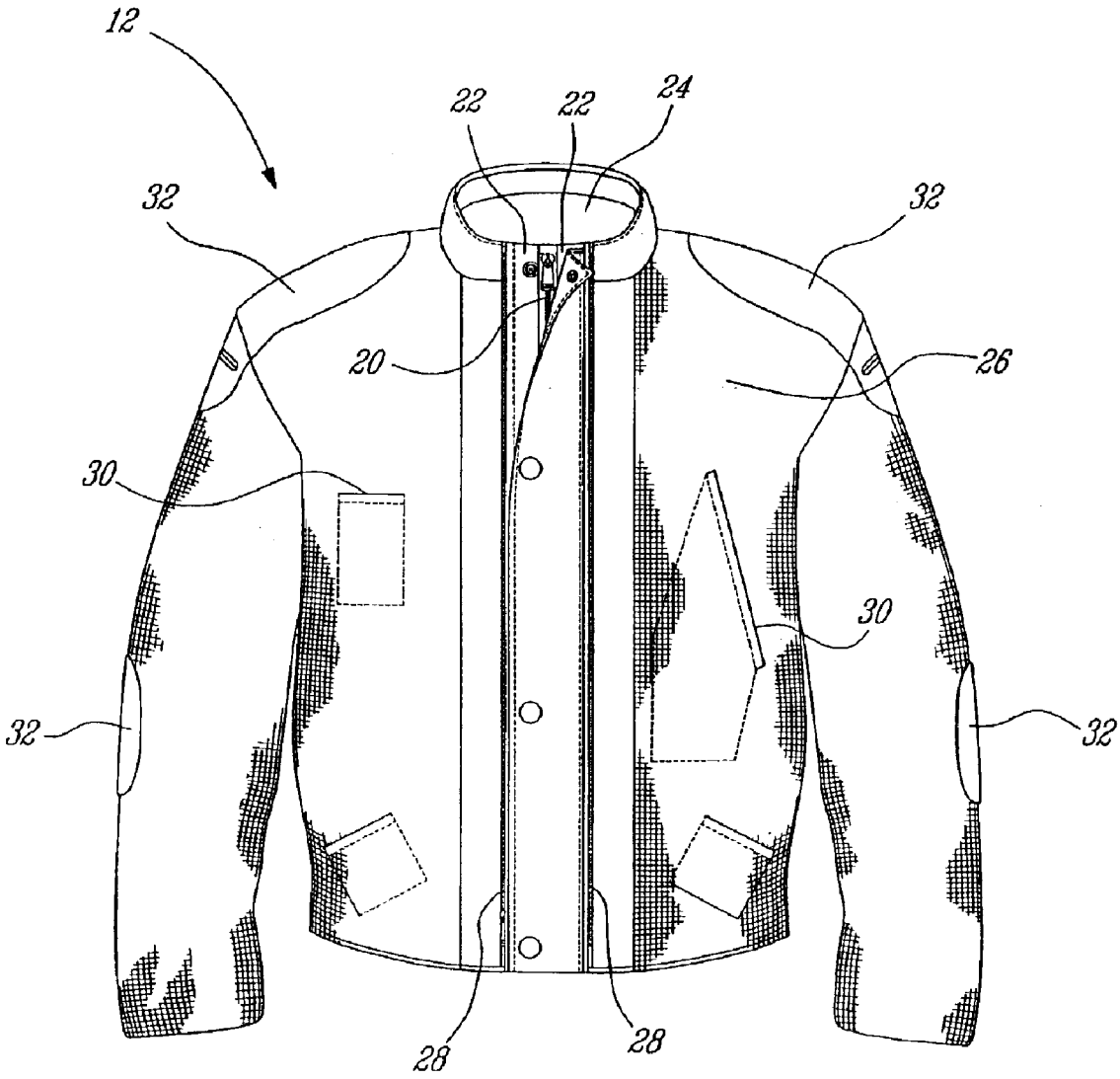
FIG. 2 shows a front elevation view of the inner shell of FIG. 1.

The inner shell 12 is shown in greater detail in FIG. 2. Contrary to most multi-layer outerwear garments, the inner shell 12 of the outerwear garment 10 is preferably a relatively thinner and lighter weight layer of the composite outerwear garment 10, relative to the outer shell 14. The inner shell 12 comprises an inner surface 24 and an outer surface 26, and includes adjacent front edges 22, each having a mating element of a closure means 20 thereon. The closure means 20 is preferably a slide fastener closure such as a zipper. However, other closure means can similarly be employed, and can include, but are not limited to, buttons, snap fasteners, hook-and-loop type fasteners, and the like. A fastening means 28 is disposed inwardly, spaced from each front edge 22, on the outer surface 26 of the inner shell 12. Each fastening means 28 comprises an element of a fastener used to engage the outer shell 14 to the inner shell 12. The fastening means 28 disposed on each side of the central closure means 20 preferably each comprises an element of a slide fastener closure such as a zipper, which is adapted for mating engagement with a corresponding counterpart fastener element disposed on the outer shell 14.

The style and look of the inner shell 12 can be varied depending on the particular use of the outerwear garment 10. FIG. 2 depicts the inner shell 12, as a jacket preferably intended for motorcycle use. As such, the inner shell 12 depicted comprises protective padding members 32 on the elbows, shoulders and back portions of the inner shell 12. As this protective padding should be worn at all times, even in warm weather conditions, the panels of the inner shell 12 preferably comprise a mesh material which permits good ventilation while providing support for the protective padding members 32 and helps retain them in place. The panels of the inner shell 12 can conversely be made from a lightweight rain-proof material such as nylon, for example, the inner shell 12 thereby providing warm weather rain protection. If the outerwear garment is to be used as a snowmobile jacket, however, the inner shell 12 is preferably proofed and, although relatively thin and lightweight relative to the outer shell 14, would nevertheless provide some degree of insulation. No matter the chosen application, any number of pockets 30 can also be provided on the outer and inner surfaces 26 and 24 of inner shell 12 as desired.

Reference is now made to FIG. 3 showing a preferred embodiment of the outer shell 14. As mentioned above, contrary to most multi-layer outerwear garments, the outer shell 14 of the present outerwear garment 10 preferably provides more protection and/or insulation that the thinner inner shell 12. The outer shell 14 comprises generally an inner surface 44 and an outer surface 46, and has adjacent font edges 42 defining a front opening therein. Opposed mating elements of a second fastening means 48 are disposed along each of the front edges 42, and can be engaged together to provide a second closure means which permits the outer shell 14 to be closed when worn by itself. Each element of the second fastening means 48 can also respectively engage each opposed fastening means 28 of the inner shell 12 such that the outer shell 14 can be fastened thereto, permitting both to be worn in combination to form the composite outerwear garment 10. The second fastening means 48 therefore provides an integrated, dual-purpose fastening and closure means, as the same zipper which can close the outer shell 14 when worn alone, is also used to fasten the outer shell 14 to the inner shell 12. The outer shell 14 also preferably includes a number of pockets 50 both on the inner surface 44 and the outer surface 46, and the style, cut, finish, and fabric of the outer shell 14 can be selected depending on the particular use of the outerwear garment 10, and will be evident to one skilled in the art.

The second fastening means 48, as do all the fastening and closure means described throughout, preferably comprises a slide fastener closure such as a zipper. However, other attachment methods can similarly be employed, and can include but are not limited to buttons, snap fasteners, hook and loop type fasteners, and the like.

Referring to FIG. 4, the engagement of the outer shell 14 to the inner shell 12 to form the assembled composite outerwear garment 10 is more clearly shown. It will be appreciated that as a result of the fastening means 28 being discrete from the closure means 20 and disposed on the outer surface 26 of the inner shell 12, that the second fastening means 48 on the front edges 42 of the outer shell 14, can be fastened thereto such that the outer shell 14 can be put on overtop the inner shell 12 and engaged therewith, without requiring the removal or opening of the inner shell 12. The outer shell 14, when fastened to the inner shell 12, substantially covers the entire outer surface 26 thereof, such that the inner surface 44 of the outer shell 14 and the outer surface 26 of the inner shell 12 are immediately adjacent each other. As clearly shown in FIG. 4 and described above, the outer shell 14 is preferably more insulated than the inner shell 12, having an internal layer of insulation 52 between the inner and outer surfaces 44 and 46 of the outer shell 14. The inner shell 12 comprises a protective weather flap 34, which covers the closure means 20. The weather flap 34 preferably extends from the outer surface 26 of the inner shell 12, and overlaps the closure means 20, to prevent wind or precipitation from passing therethrough. A number of snap fasteners 36, each comprising corresponding mating elements on the inner surface of the weather flap 34 and the outer surface 26 of the inner shell 12 near the front edges 22, permit the weather flap 34 to be fastened closed over the closure means 20. The outer shell 14 can also comprise any number of pockets 50 on both the outer surface 46 and the inner surface 44 thereof. It is to be understood, however, that the protective weather flap 34 can be eliminated if desired, without affecting the function of the outerwear garment 10 or the attachment between the inner shell 12 and the outer shell 14.

As noted above, both the inner shell 12 and the outer shell 14 can be worn individually, and as such are fully functional garments in their own right. However, in general use, the inner shell 12 is preferably most often worn alone because, as a result of the fastening system described in detail above, the outer shell 14 can be fastened to the inner shell 12, overtop thereof, without having to first remove the inner shell 12. As mentioned, this can be very practical for applications in which removal of the inner shell 12 would mean exposing the user to undesirable climatic elements. For example, a snowmobile or motorcycle rider, wearing only the thin inner shell 12 as the weather was initially relatively mild, may experience mid-ride a sudden weather change which brings with it rain or snow. The rider can stop the vehicle and quickly put on the more protective and/or insulated outer shell 14 overtop the lighter inner shell 12 and fasten the outer shell 14 to the inner shell 12 without having to remove or open the inner shell 12. This is not possible with commonly used multi-layer garments, which require the thin outer shell to be completely removed before an insulating layer can be fastened therewithin, in order to permit the conversion from a single-layer, mild weather jacket to a warmer, double-layer jacket. The present outerwear garment 10 avoids this, by having a generally lightweight inner shell 12 and a more protective and/or insulated outer shell 14, which can be fastened to the inner shell 12 as described above without the user having to remove the inner shell 12.

The embodiments of the invention described above are intended to be exemplary. Those skilled in the art will therefore appreciate that the forgoing description is illustrative only, and that various alternatives and modifications can be devised without departing from the spirit of the present invention. Accordingly, the present is intended to embrace all such alternatives, modifications and variances which fall within the scope of the appended claims.

What is claimed is:

1. An outerwear garment comprising:

an inner shell adapted for independent wear and having first closure means at first front edges thereof and first fastening means spaced from said first front edges on an outer surface of said inner shell, said first closure means closing said first front edges of said inner shell; and an insulated outer shell having greater insulating properties than said inner shell and including second closure means, said second closure means being engageable with said first fastening means for removably fastening said insulated outer shell to said inner shell overtop thereof, to provide more insulation to said inner shell without requiring removal thereof by a user.

2. The outerwear garment as defined in claim 1, wherein said second closure means comprises at least two opposed fastening elements capable of mutual, mating engagement and of engagement with said second closure means, each of said opposed fastening elements being disposed on respective second front edges of said insulated outer shell.

3. The outerwear garment as defined in claim 2, wherein said first fastening means comprises at least two opposed fastening elements for mating engagement with said second closure means.

4. The outerwear garment as defined in claim 3, wherein said first fastening means and said second closure means comprise slide fastener closures.

5. The outerwear garment as defined in claim 2, wherein said insulated outer shell is adapted for independent wear, and said opposed fastening elements of said second closure means are capable of mutual mating engagement to close said insulated outer shell when worn alone.

6. The outerwear garment as defined in claim 1, wherein said first closure means of said inner shell provides closure of said outerwear garment when said insulated outer shell is fastened to said inner shell.

7. The outerwear garment as defined in claim 1, wherein said first closure means comprises a slide fastener closure.

8. The outerwear garment as defined in claim 1, wherein said outerwear garment is an outdoor sports jacket.

9. The outerwear garment as defined in claim 8, wherein said outdoor sports jacket is one of a snowmobile jacket and a motorcycle jacket.

10. The outerwear garment as defined in claim 8, wherein said outdoor sports jacket is a winter outdoor sports jacket.

11. An outerwear garment comprising an inner shell having first closure means at first front edges thereof and first fastening means spaced from said first front edges on an outer surface of said inner shell; said inner shell being adapted for removable engagement with an insulated outer shell having greater insulating properties than said inner shell, said insulated outer shell having second closure means engageable with said first fastening means for removably fastening said insulated outer shell to said inner shell overtop thereof, to provide more insulation to said inner shell without requiring removal thereof by a user.

12. The outerwear garment as defined in claim 11, wherein said second closure means comprises at least two opposed fastening elements capable of mutual mating engagement and of engagement with said second closure means, each of said opposed fastening elements being disposed on respective second front edges of said insulated outer shell.

13. The outerwear garment as defined in claim 12, wherein said first fastening means comprises at least two opposed fastening elements for mating engagement with said second closure means.

14. The outerwear garment as defined in claim 13, wherein said first fastening means and said second closure means comprise slide fastener closures.

15. The outerwear garment as defined in claim 12, wherein said insulated outer shell is adapted for independent wear, and said opposed fastening elements of said second closure means are capable of mutual mating engagement to close said insulated outer shell when worn alone.

16. The outerwear garment as defined in claim 11, wherein said first closure means of said inner shell provides closure of said outerwear garment when said insulated outer shell is fastened to said inner shell.

17. The outerwear garment as defined in claim 11, wherein said first closure means comprises a slide fastener closure.

18. The outerwear garment as defined in claim 11, wherein said outerwear garment is an outdoor sports jacket.

19. The outerwear garment as defined in claim 18, wherein said outdoor sports jacket is one of a snowmobile jacket and a motorcycle jacket.

20. The outerwear garment as defined in claim 18, wherein said outdoor sports jacket is a winter outdoor sports jacket.

* * * * *